United States Patent [19]

Johnson et al.

[11] 4,446,807

[45] May 8, 1984

[54] MOORING APPARATUS FOR FLOATING VESSELS

[75] Inventors: Charles A. Johnson, Lakeville, Minn.; Laurence H. Lucker, Jr., Media, Pa.

[73] Assignee: American Hoist & Derrick Company, St. Paul, Minn.

[21] Appl. No.: 270,857

[22] Filed: Jun. 10, 1981

[51] Int. Cl.[3] ..... B63B 21/50

[52] U.S. Cl. ..... 114/230; 114/265; 114/293; 441/25; 254/277

[58] Field of Search ..... 114/125, 144 B, 264–267, 114/293, 199, 200, 230; 441/23–27, 29, 21; 254/277, 384–386, 228, 264

[56] References Cited

U.S. PATENT DOCUMENTS

| | | | |
|---|---|---|---|
| 3,031,997 | 5/1962 | Nesbitt | 114/5 |
| 3,191,201 | 6/1965 | Richardson | 114/264 |
| 3,275,300 | 9/1966 | Delacour et al. | 254/264 |
| 3,318,275 | 5/1967 | Field | 114/125 |
| 3,349,740 | 10/1967 | Field | 114/125 |
| 3,525,312 | 8/1970 | Beck et al. | 441/23 |
| 3,540,396 | 11/1970 | Horton | 114/293 |
| 3,563,043 | 2/1971 | Nelson | 114/293 |
| 3,842,776 | 10/1974 | Wudtke | 114/206 |
| 4,020,779 | 5/1977 | Kitt | 114/293 |
| 4,070,981 | 1/1978 | Guinn et al. | 114/293 |
| 4,091,760 | 5/1978 | Lloyd | 114/264 |
| 4,200,052 | 4/1980 | Cunningham et al. | 114/144 B |

OTHER PUBLICATIONS

Baldt, Bulletin 0478, Chester, Pa., 1978.

Lucker Catalog ME-L600, marked 10 MJR9-80.

Lucker Catalog No. 500, entitled *Lucker Manufacturing Company* (see p. 5).

2-Page brochure entitled "Air-Controlled Single Drum Anchor Hoist Model 3000 Specifications and Ratings, identified as SPEC. NO. 100-AH-3000 A".

*Primary Examiner*—Trygve M. Blix

*Assistant Examiner*—Stephen P. Avila

*Attorney, Agent, or Firm*—Kinney & Lange

[57] ABSTRACT

A mooring apparatus for a semi-submersible oil exploration and drilling rig includes eight drum anchor hoists and winches on which are carried eight wire rope mooring lines. Each of these lines extends up over one of eight head sheaves and vertically down the outside face of the oil rig through a fairleader rotatably mounted with respect to the rig at a bottom submerged portion thereof. A linear line pull machine is mounted to the rig in encompassing relation to each of the vertical runs of mooring line between the head sheave and the fairleader. These eight mooring line assemblies are distributed around the periphery of the rig. Two mooring lines extend at 90° from each other at each corner of the rig. At least one hydraulic power unit is provided for each two of these mooring line assemblies, and air and hydraulic control means are provided utilizing power from this power unit selectively to: (1) reel out and reel in on the mooring lines when low line forces are involved using the anchor hoist; (2) to exert extremely high forces at slow speeds when necessary to set anchors attached to outer ends of the mooring lines and to positively hold the rig against the upward buoyant effect of the rig's pontoons; or (3) to operatively disassociate the linear pull machines from the mooring lines so that the mooring lines can be reeled outwardly at very high speeds.

2 Claims, 11 Drawing Figures

MOORING APPARATUS FOR FLOATING VESSELS

BACKGROUND OF THE INVENTION

This invention has relation to the mooring of floating vessels over predetermined locations on the floors of bodies of water. More specifically it relates to the rapid paying out and drawing in of extensive lengths of wire rope mooring lines under conditions of no load or low load, and the holding and more deliberate drawing in and paying out of such lines under conditions of very high loading on the lines.

It is known to anchor semi-submersible offshore drilling platforms in place utilizing elongated anchor lines extending out from such plaftforms in all directions. See U.S. Pat. No. 3,842,776 granted to Wudtke in October of 1974 and U.S. Pat. No. 4,020,779 granted to Kitt in May of 1977. See also U.S. Pat. No. 3,031,997, granted to Nesbitt in May of 1962; and U.S. Pat. Nos. 3,318,275 and 3,349,740, the first granted to Field in May of 1967 and the second granted to him in October of 1967.

Mooring lines stretching out in all directions from the bottom of a cylindrical opening passing from top to bottom through a central portion of an otherwise conventional ship are shown in U.S. Pat. No. 3,191,201 granted to Richardson et al in June of 1965.

U.S. Pat. No. 3,563,043 granted to Nelson in February of 1971 as well as all of the patents listed above were uncovered in a search of the prior art. The Nelson patent is not believed to be particularly pertinent to the present invention.

Semi-submersible oil exploration and drilling platforms include horizontal floats or pontoons which are entirely air-filled to cause the platforms to float on the surface of the water while they are being towed into place. In order to minimize the effects of oceans swells and waves on the platforms, the pontoons are submerged during use of the platforms for their intended purposes. This subjects only the main vertical support columns to the surface action of the sea.

Once a platform is in its desired position, the sea water can be let into the pontoons to achieve the desired submersion of the platform. Then in the process of fixedly mooring the platform, the water can be evacuated from the pontoons, leaving the mooring lines passing through fairleads located at lower portions of the platform to restrain the platform from rising as the pontoons become more and more buoyant. This has the effect of very positively and firmly fixing the positioning of the platform over a drilling point, for example, and very substantially diminishes the effects of surface action of the seas on the platform. After and as the pontoons are evacuated, extreme upward forces are being absorbed by the mooring lines.

In floating offshore drilling platforms and in similar vessels, deck space and other working space is at a premium. The economic effectiveness of a particular vessel is measured in proportion to the amount of space available to perform the primary function of the vessel (drilling for oil, for example) and in reverse proportion to the amount of space required for the necessary subsidiary functions (holding the vessel in place and handling and storing the mooring lines, for example).

As disclosed in Wudtke U.S. Pat. No. 3,842,776, a large winchdriven drum 38 has to be able to store all of the wire rope 40 before mooring and to transmit sufficient pull on the mooring line to keep the vessel semisubmerged. The drum 38 must be so large that it has to be mounted on the top of one of the support columns 30 of the offshore platform. The drum 38 must have a substantial distance between its end flanges so that the maximum pulling force needed can be developed without too many layers of wire wound on it. In other words, the radial distance between the outer strand or pulling strand of wire rope going onto the drum measured on the radius of the drum must be kept to a minimum in order to develop the necessary pulling forces where the winch is doing all of the pulling on the wire rope.

Linear pulling machines which operate on wire rope are well known. For example, such machines are sold under the trademark LUCKER by American Hoist & Derrick Company, Marine/Energy Division, 63 South Robert Street, St. Paul, Minn. 55107. See Lucker Catalog ME-L600, marked 10 MJR9-80, an earlier Catalog No. 500 entitled *Lucker Manufacturing Company* and marked 25 MJR477.

It is known to use storage reels to automatically wind up and store the wire rope coming from the linear pull machine. See the upper right-hand corner of page 5 of said Catalog No. 500.

What was needed before the present invention was a power operated winch which was compact enough so that it could be positioned at a location where it would not use up valuable deck and other work space. At the same time, a further power means was needed which could exert high forces on the mooring line to draw it in and pay it out under severe load conditions, and which could hold the line under static conditions even up to the tensile strength of the line itself, this further power means also taking up no deck space or other space useable for the primary mission of the vessel.

Applicants and those in privity with them are aware of no closer prior art than that discussed and disclosed above; and they are aware of no prior art which anticipates the claims herein.

BRIEF SUMMARY OF THE INVENTION

An apparatus for drawing in, holding and paying out on a flexible load line such as a wire rope in the process of mooring a floating vessel includes the load line, power means on the vessel for drawing in and storing an inner end portion of the load line, fairlead means mounted with respect to a lower part of the vessel in encompassing and guiding relationship to the load line between the power means and an outer end of the load line, and load means such as an anchor connected to the outer end of the load line. Load line guide means is mounted on the vessel in vertical alignment above the fairlead means and the load line extends through this guide means between the storage means and the fairlead means.

The power means includes a power unit, winch means, and a linear line pull machine.

The winch means is mounted on the vessel and includes a winch drum to which an inner end of the load line is attached. The load line extends from the winch drum to the load line guide means. The winch means can be operated selectively to either: (1) exert a relatively high torque to draw in on the load at relatively slow speeds, or (2) exert a relatively low torque to draw in on the load line at relatively high speeds under light load conditions, or (3) run free to allow the load line to be drawn from it, or (4) stop and prevent rotation of the winch drum to hold the load line from movement away from the vessel.

The linear line pull machine is mounted on the vessel between the guide means and the fairlead means in encompassing relation to the load line. This linear pull machine can selectively either: (1) exert a relatively high force to draw in or to pay out on the load line at relatively slow speeds, (2) hold the load line against outward movement, or (3) move into clearing relation with respect to the load line to allow the load line to be drawn very rapidly from the storage means or to allow the storage means to draw in on the load line when under conditions of low load.

IN THE DRAWINGS

DESCRIPTION OF PREFERRED EMBODIMENT

Figure 1:
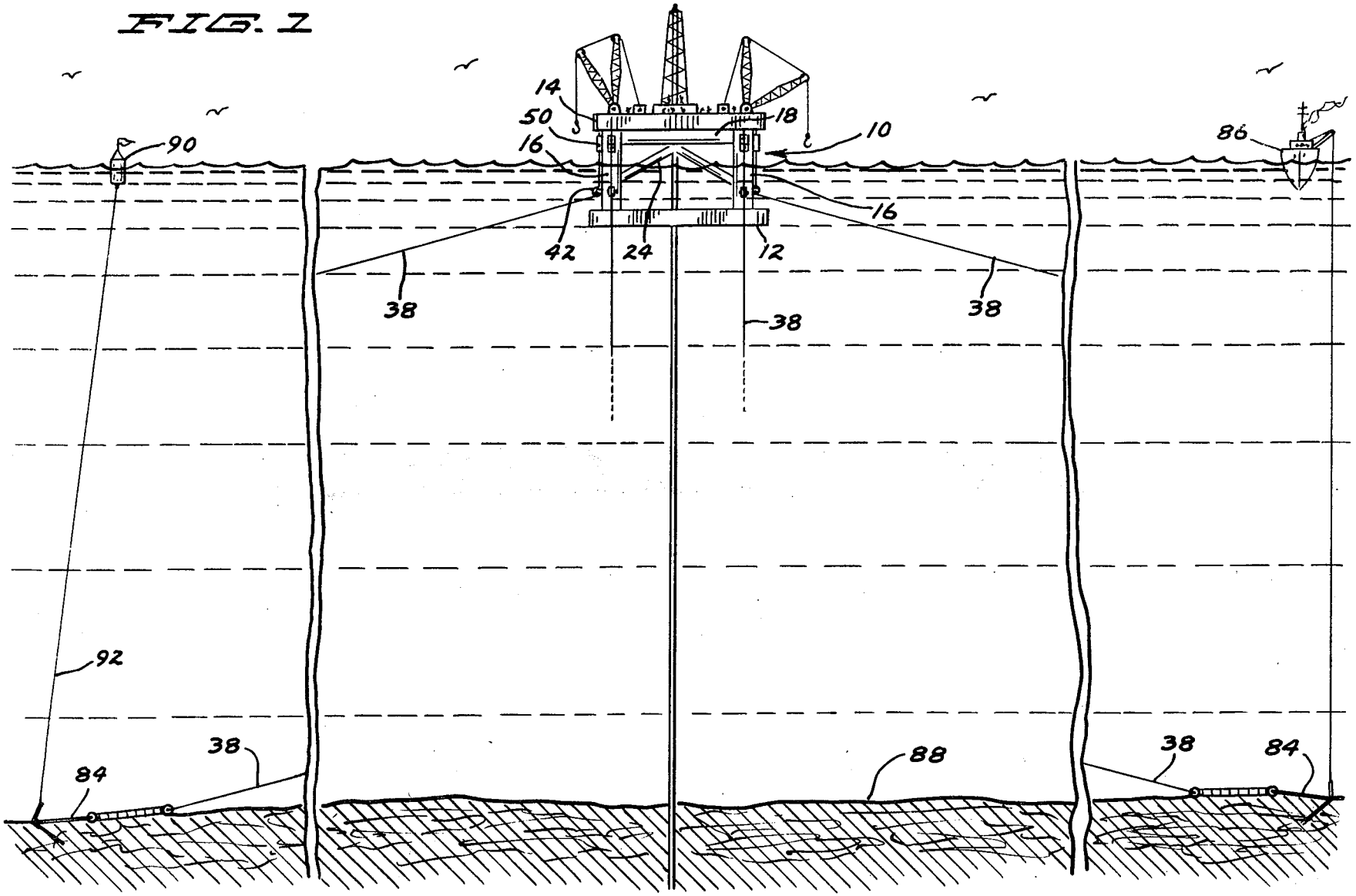
FIG. 1 is an elevational view of a semi-submersible offshore oil exploration and drilling platform employing the mooring apparatus of the present invention.
Figure 2:
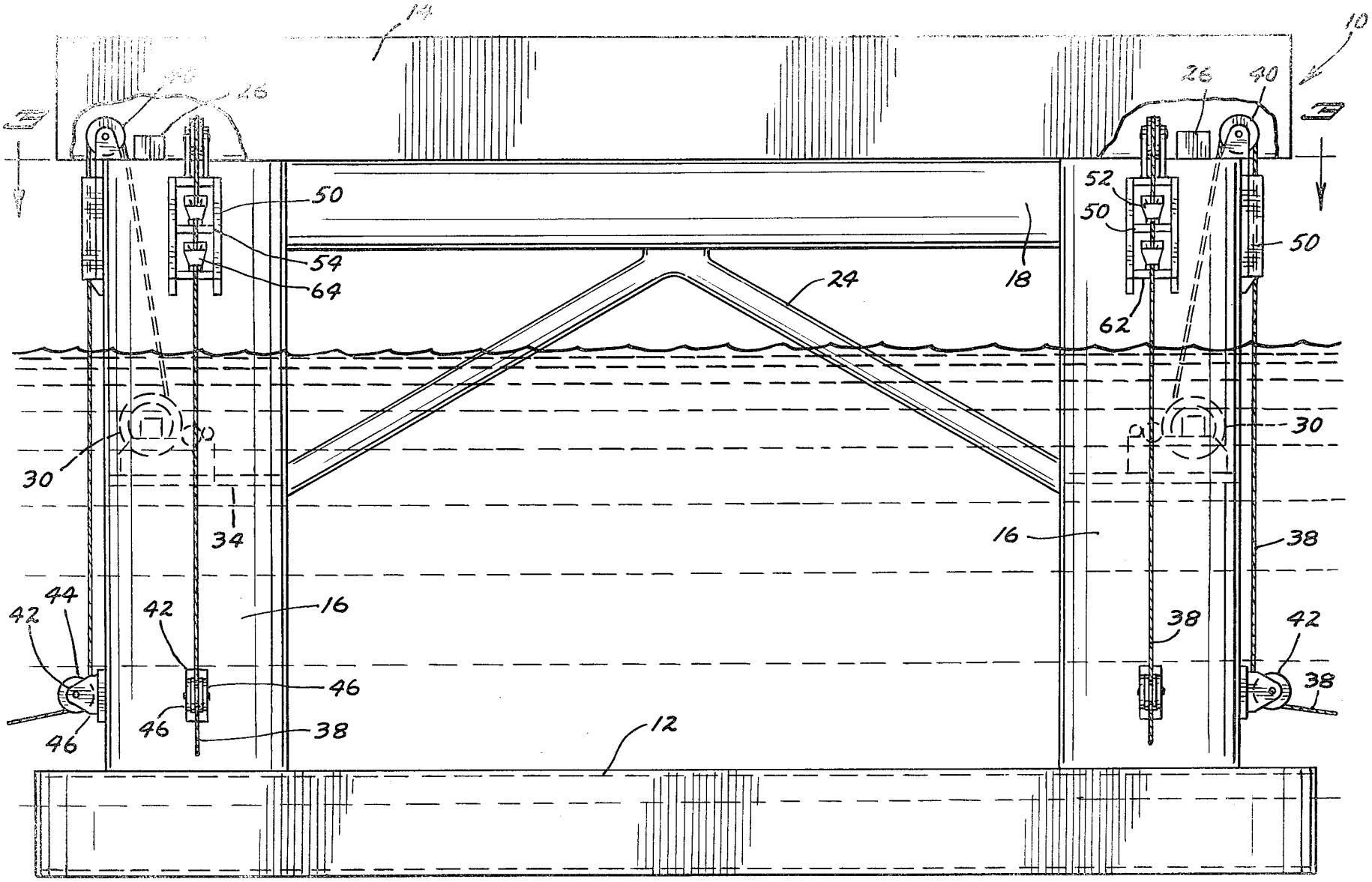
FIG. 2 is an enlarged elevational view of the platform and some of the apparatus of FIG. 1.
Figure 3:
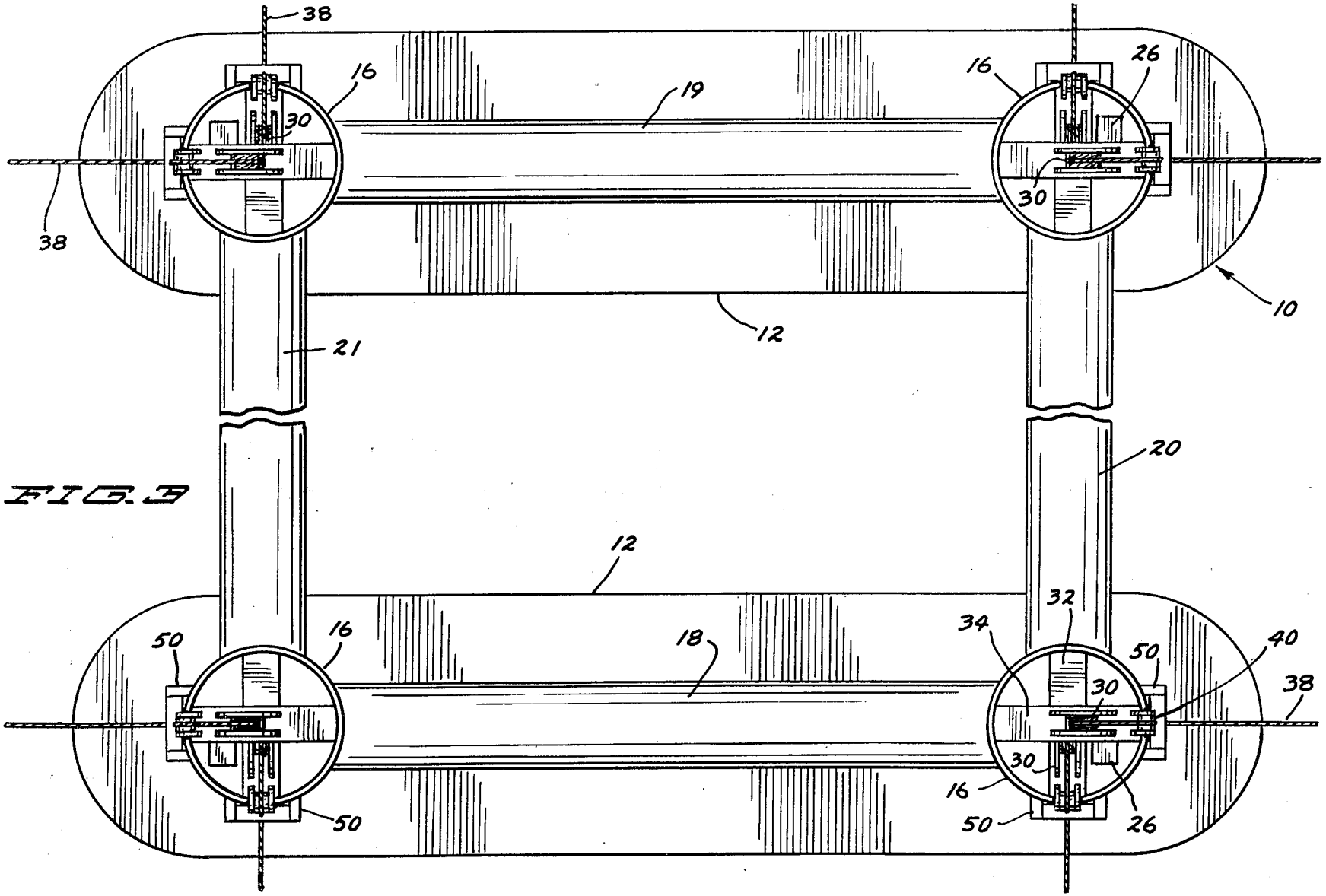
FIG. 3 is a top plan view of the platform and apparatus of FIGS. 1 and 2 taken on the line 3—3 in FIG. 2 with parts omitted for clarity of illustration.
Figure 4:
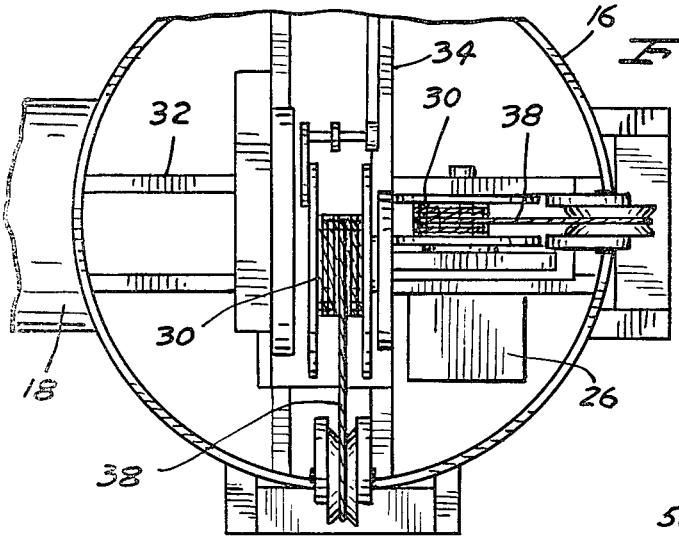
FIG. 4 is an enlarged fragmentary top plan view of one of the four main vertical support columns.
Figure 5:
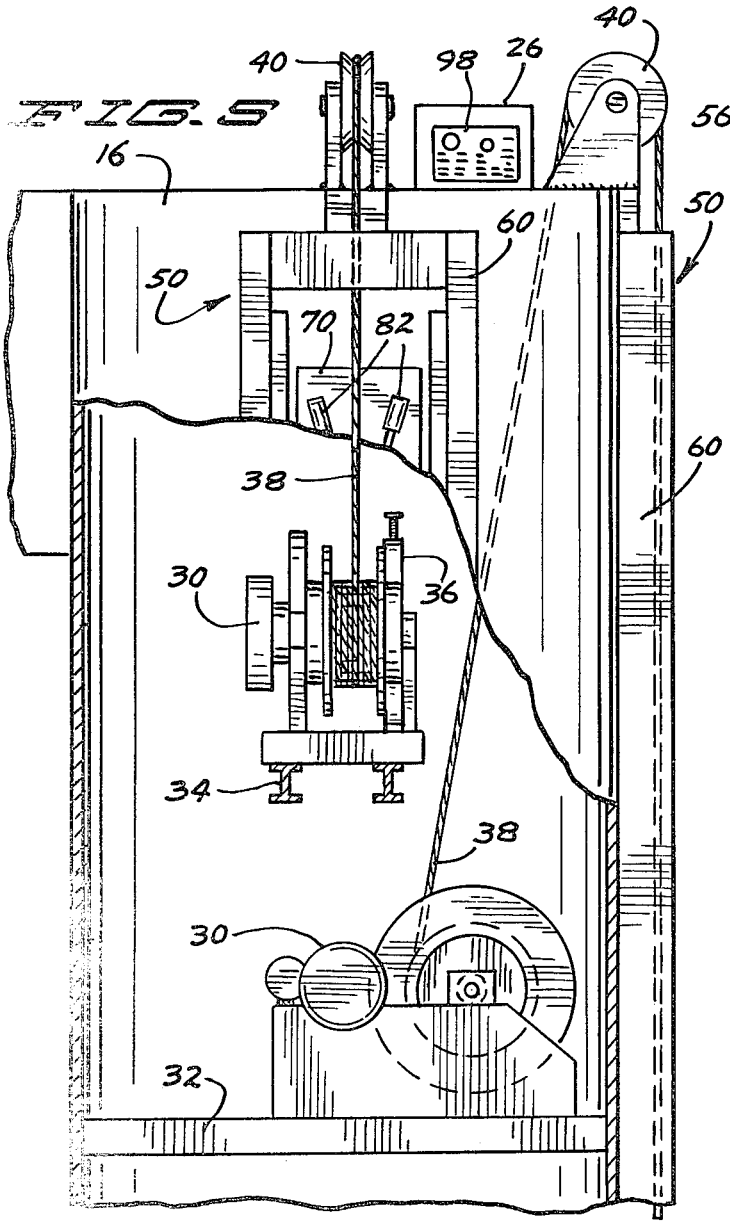
FIG. 5 is a fragmentary elevational view of an upper portion of the vertical support column of FIG. 4 with parts in section and parts broken away.

A semi-submersible oil exploration and drilling platform or vessel 10 is shown in FIGS. 1 through 6 as including a pair of horizontal pontoons 12,12 supporting a deck 14 on four main vertical cylindrical hollow support columns 16. Horizontal support braces 18, 19, 20 and 21 extend between adjacent support columns 16 and underlie the deck 14 to provide support for the deck. Diagonal braces 24 between the horizontal braces and the vertical support columns add further rigidity.

The pontoons 12 can be selectively opened to sea water or can be pumped dry in any usual or preferred manner (using equipment not shown) depending on whether it is desired to initially have the platform or vessel float with the pontoons submerged or float on the surface of the supporting body of water. The platform is also provided with a source of electrical energy (not shown) of any usual or preferred type. All of the structure described to this point is well known in the prior art and forms no part of the present invention per se.

In the form of the invention shown, the power source for operating the apparatus of the invention includes a power unit 26 associated with the top of each of the support columns 16. The details of these power units are not shown, as these units could take many forms in providing the necessary hydraulic fluid and air under pressure to operate the illustrated apparatus of the invention. Motors and hydraulic pumps could be provided in each of the four power units 26.

Eight separate air-controlled single drum anchor hoists or winches 30 are provided, two being mounted inside of each of the hollow vertical support columns 16. One of each pair of winches 30 is mounted on a lower transversely extending winch support frame 32; while the other winch of the pair is mounted at right angles to the first winch on an upper transversely extending winch support frame 34. Each winch includes an external band type brake 36 which is spring set and air released in the form of the invention as shown. Many different power operated winches would be satisfactory for this purpose, but an American Hoist & Derrick Company Model 3000 Anchor Hoist with drum grooved to receive 4½ inch (11.43 cm) diameter wire rope and having a capability of operating at high speed/low torque and of operating at low speed/high torque will be satisfactory. A specification and rating sheet for an electrically driven version of this hoist identified as Spec. No. 100-AH-3000A and dated 12-75 is incorporated into this specification by this reference hereto.

A flexible mooring line such as wire rope 38 includes an inner end portion which is fastened to and wound on the drum of each anchor hoist or winch 30. This line extends up out of the top of its support column 16 to be encompassed by and guided by a head sheave or guide means 40 which is suitable rotatably mounted with respect to a top edge of this support column 16.

At a lower portion of each vertical support column 16, a fairleader or fairlead means 42 is mounted below each head sheave or guide means 40 in position so that mooring line 38 being encompassed by and guided by head sheave 40 will run vertically down from that sheave and onto the fairleader or fairlead means 42 where it will be encompassed and guided by that fairleader. The fairleader includes a sheave 44 which is rotatably mounted on a horizontal axis with respect to side plates 46,46 of the fairleader. These side plates are pivotally mounted on a vertical axis with respect to a lower portion of the support column 16.

Mounted on the outside vertical cylindrical wall of each main support column 16 are a pair of linear line pull machines 50,50, each in encompassing relationship with respect to one of the flexible mooring lines 38. As perhaps best seen in FIG. 6, each line pull machine 50 includes an upper gripper assembly 52 mounted on a cross head 54. A pair of upper gripper guide ears 56, 56 extend outwardly from the upper gripper to slide with respect to guide tracks 58,58 which are fixedly mounted along with a main pull machine frame 60 to the outer surface of the support column 16.

Figure 6:
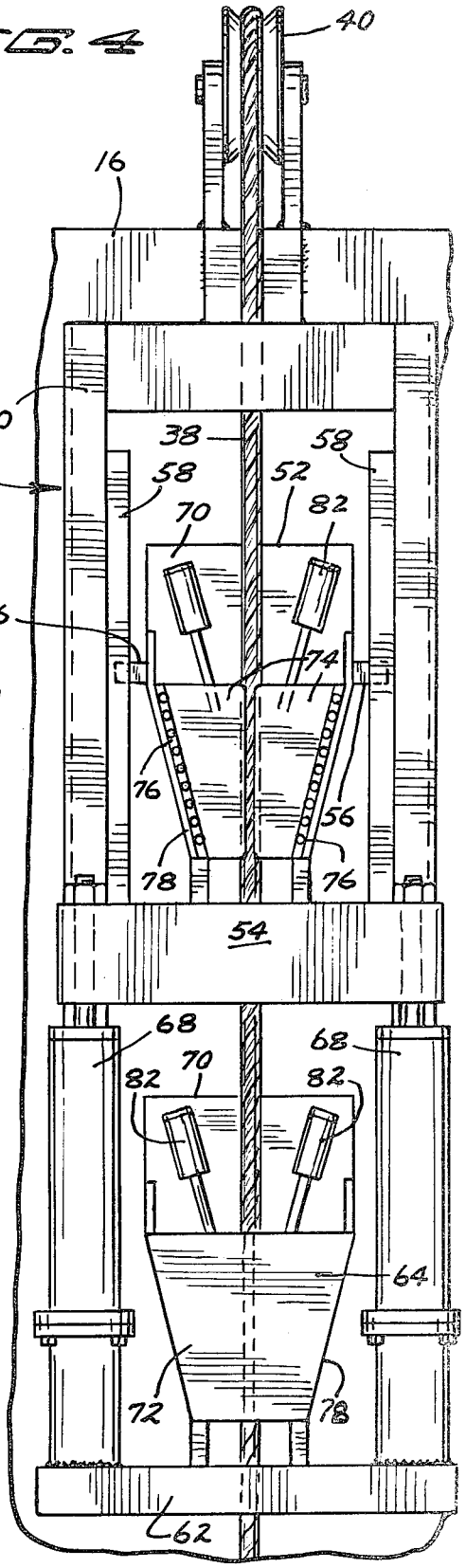
FIG. 6 is an enlarged fragmentary elevational view of a portion of the vertical support column of FIGS. 4 and 5 as seen from the right in FIG. 5 with the face plate of the lower gripper assembly removed for purposes of illustration.

This main frame 60 includes a base pedestal 62 on which is supported a lower gripper assembly 64, and a pair of linear piston-cylinder hydraulic puller motors or rams 68,68 on which the cross head 54 is supported. Each gripper assembly 52 and 64 includes a backplate 70 and a face plate 72. In FIG. 6, the face plate is shown as being removed from the upper gripper assembly 52 in order to more clearly illustrate the operation of the line pull machines. As most clearly seen in that figure, each of the gripper assemblies 52 and 64 include gripper jaws 74,74 which are appropriately grooved to receive and act on the flexible mooring line 38. Roller bearings 76 support the outer diagonal faces of these jaws on diagonal side walls 78,78 which form an integral part of each of the gripper assemblies 52 and 64.

Mounted on the backplate 70 of each of the gripper assemblies 52 and 64 are the cylinders of a pair of cylinder-piston linear gripper motors 82,82. The pistons of each of these gripper motors are each connected to one of the gripper jaws 74,74. When these motors 82 of a particular gripper assembly are activated to move the pistons into the cylinders, the gripper jaws 74,74 of that gripper assembly will be moved upwardly with respect to mooring line 38 and diagonal side walls 78,78 thus moving that gripper assembly effectively into clearing relationship with respect to the mooring line.

When the gripper motors of a gripper assembly are activated to extend their pistons outwardly and downwardly from their cylinders, the gripper jaws 74,74, acting under the influence of diagonal side walls 78,78 and roller bearings 76, are brought into contacting and positive gripping relationship with respect to the wire rope flexible mooring line 38.

OPERATION

Figure 9A:
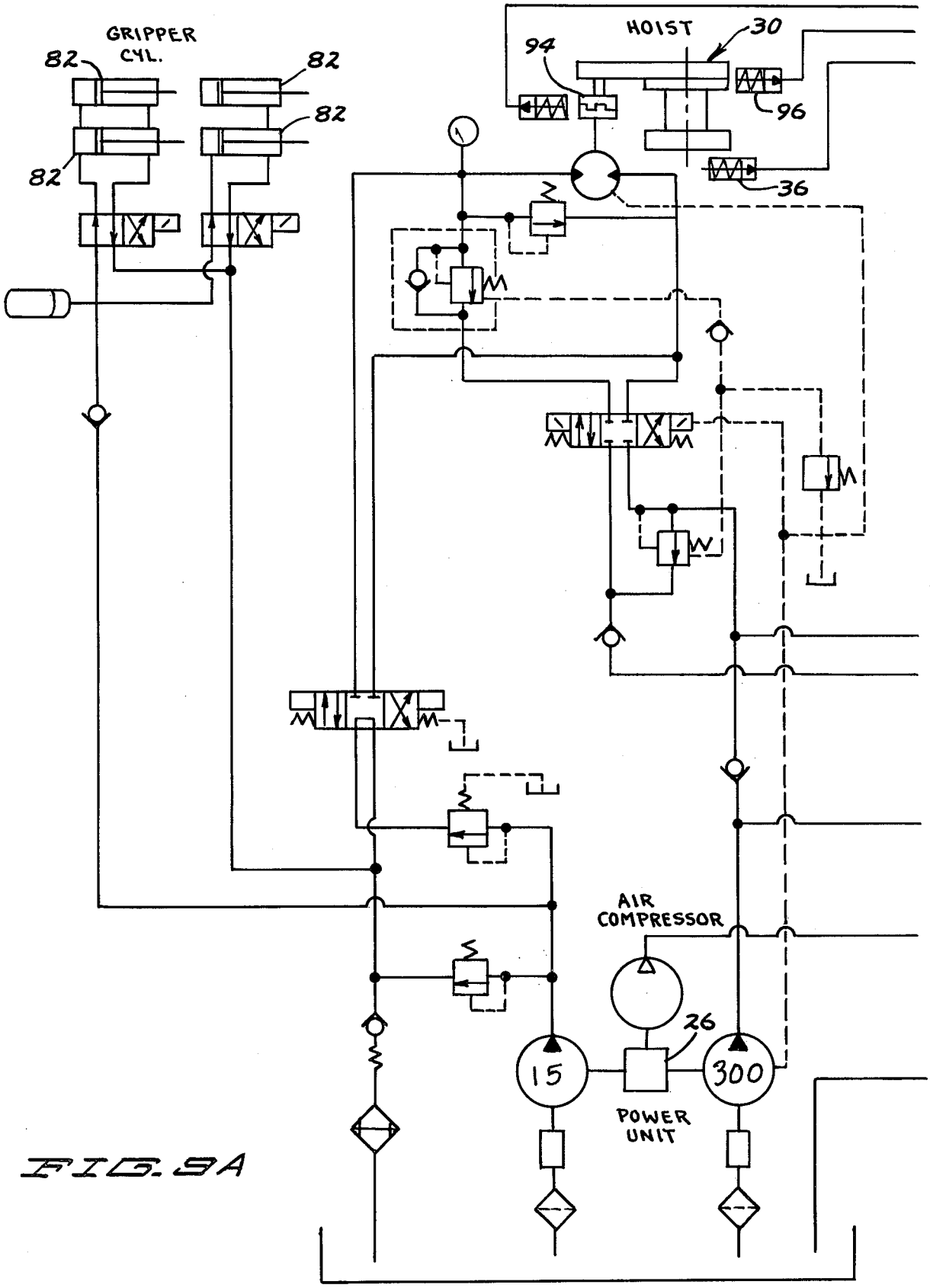
FIGS. 9A and 9B are a schematic representation of one form of a hydraulic system and air for the present invention.
Figure 9B:
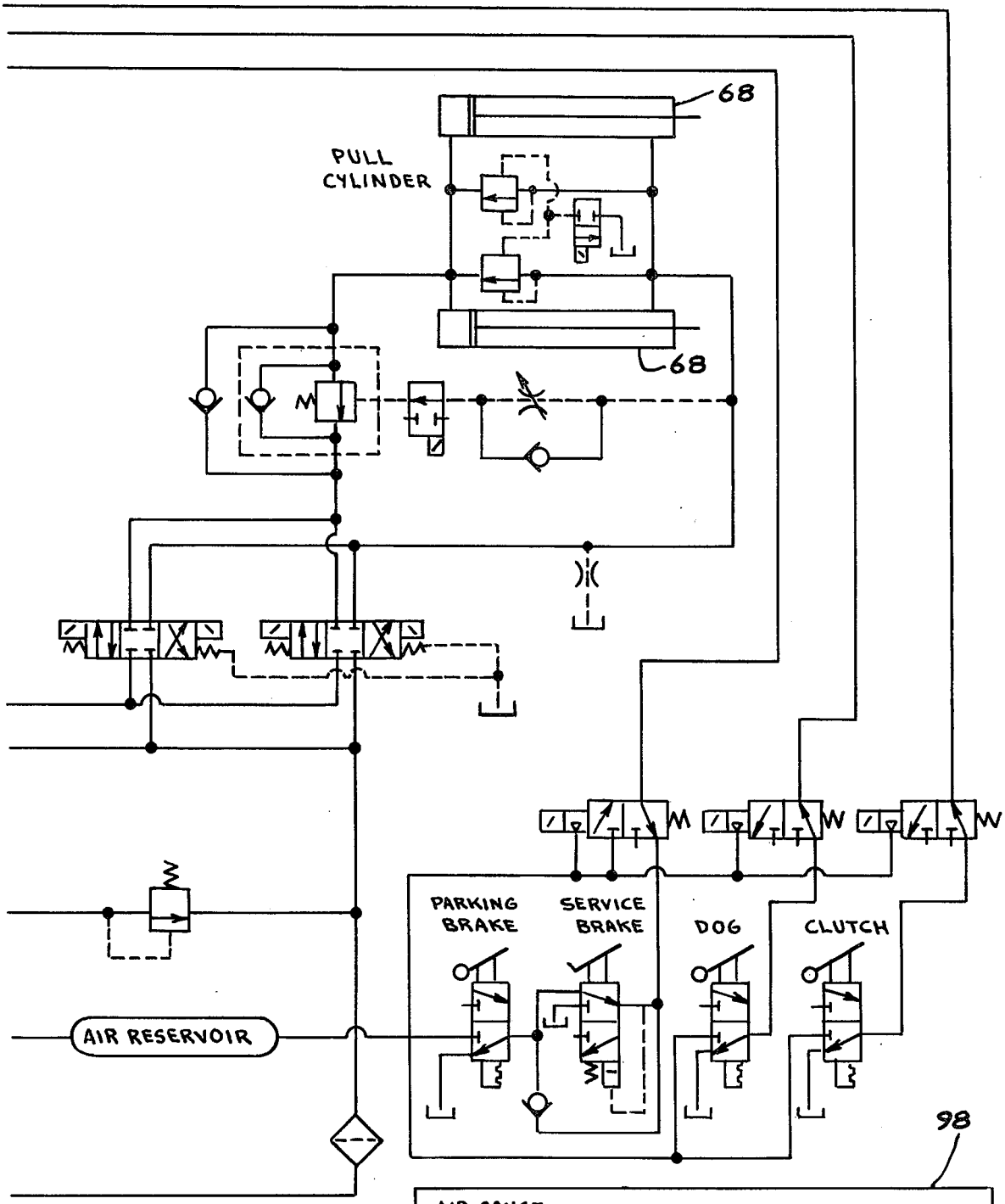

To make use of the apparatus of the invention as disclosed in FIGS. 1 through 6 and 10 and to make use of the control apparatus such as that shown in simplified form in FIGS. 9A and 9B, the semi-submersible oil exploration and drilling platform or rig 10 can be towed into position for use with all of the pontoons 12 evacuated, thus supporting the rig with the pontoons substantially at the surface of the water. The pontoons can then be flooded sufficiently to support the rig at somewhat below the desired final desired deck elevation with respect to the surface of the sea or other body of water. In other words, at or somewhat below the position as illustrated in FIG. 1.

With mooring line 38 extending from one of the anchor hoists or winches 30, in guided relationship with respect to the head sheave or guide means 40, down through a linear pull machine 50, and through fairlead means 42, an anchor 84 is attached to the outermost end of the mooring line. The anchor is offloaded onto a tug or other appropriate tender vessel 86. Both pairs of cylinder-piston gripper motors 82,82 of the linear pull machine are activated to move the gripper jaws 74 out of contact with the mooring line 38, the brake 36 on winch 30 is air released, and the tender vessel or tender 86 hauls out the anchor 84 and mooring line 38 to position the anchor substantially directly over where it is going to be needed to combine with the other seven anchors and mooring lines to position the drilling platform or rig 10 in its desired location while it is being used for its intended purpose. An anchor trip line or buoy line 92 will be attached to the anchor and the anchor will then be lowered to the sea bottom 88, and a buoy 90 attached to the anchor line to identify the anchor location.

This process is repeated seven more times until all eight anchors are in their working positions.

The anchors can then be set, one pair at a time. The anchors making up each pair are those which are connected to mooring lines in direct opposition to each other. For example, the anchors 84 and 84 as seen from the left and right lower corners of FIG. 1 will be set at the same time so that the net effect on the positioning of the rig 10 will be negligible.

Setting of each pair of anchors is accomplished by engaging the hoist clutch 94 of each of the anchor hoists or winches 30 and driving the winch in direction to wind in on mooring line 38 at high speed and low torque until the slack is out of each of the mooring lines. Next the winches can be operated at slow speed/high torque to approach the tension desired in the load lines. Then the cylinder-piston linear gripper motors 82 of the lower gripper assemblies 64 will be activated to cause the corresponding gripper jaws 74 to firmly and positively grip the mooring lines 38. With the linear piston-cylinder hydraulic puller motors or rams 68,68 in their retracted position to position the crossheads 54 to their retracted positions, the linear gripper motors 82 of the upper gripper assemblies 52 will be activated to cause the corresponding gripper jaws 74,74 to positively grip the mooring lines 38. Each of the hydraulic puller motors 68,68 of each of the pair of opposed pull machines 50 will be activated to cause the crosshead 54 to move the upper gripper assembly 52 in upwards direction pulling with it the mooring line 38. Because of the wedge-shape construction of the gripper jaws, this upward movement of line 38 will not be impeded by the gripper jaws 74 of the lower gripper assembly 64.

When the crosshead 54 and the hydraulic puller motors 68,68 reach the upper limit of their travel and start back down, the wedge action of the gripper jaws 74 of the lower gripper assembly 64 will prevent the mooring line from moving in downward direction. When the upper gripper assembly 52, the crosshead 54 and the hydraulic puller motors 68,68 again reach their lowermost position, the gripper 74 of this upper gripper assembly will again take over and pull the mooring line 38 in upward direction.

During this operation, hydraulic fluid will continue to urge the anchor hoist 30 to wind in on the mooring line 38 but under relatively low torque to the end that the winch 30 is acting at that time simply like a takeup reel.

This operation is continued until the desired initial tension is achieved on the opposed mooring lines 38,38. When all anchors have been set and all four pairs or eight mooring lines have been properly and initially tensioned, even further tensioning can be achieved to lower the rig in the water to the desired level.

Minor adjustments in the positioning of the rig can be made by paying out on one or more of the mooring lines under power and taking in on one or more of the other lines under the same kind of low speed high power just described until the precisely desired positioning of the rig 10 is obtained. At this point, an anchor hoist dog 96 can be set so that there can be no further movement in or out from the winch or anchor hoist 30. The gripper motors 82,82 will be powered to tend to move their pistons out of their cylinders thus providing the maximum holding or wedging action on the gripper jaws 74,74, and so the rig 10 becomes permanently moored in its precise position with the surface winds and wave action having a minimum effect. Using this apparatus, the pull motors are capable of holding the mooring lines 38 under any applied force along those lines up to the breaking point of the lines themselves.

Should more or less tension be desired on the mooring lines for any reason, once the lines are set in position as described above, this tension can be achieved by evacuating more of the water from the pontoons 12 or by introducing more water into those pontoons.

Many forms of hydraulic and pneumatic circuitry could be used to accomplish the purposes of the invention, but that circuitry shown in FIGS. 9A and 9B taken together with the aforementioned Lucker Catalog ME-L600 and Catalog No. 500, and together with the information contained in the operating manuals for the equipment shown in those catalogs will provide ample assistance to those skilled in the art to make use of the invention.

Figure 10:
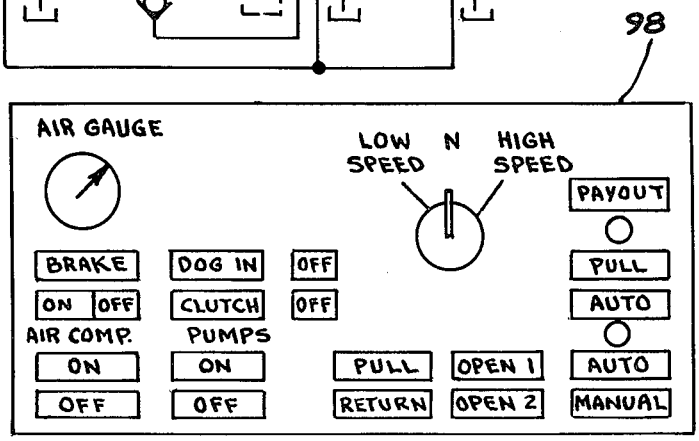
FIG. 10 is a plan view of the control panel for the system of FIG. 9.

Using the circuitry such as that shown in FIG. 9 a control panel 98 forming a part of the outer wall of each power unit 26 can have the appearance as seen in FIG. 10.

Figure 7:
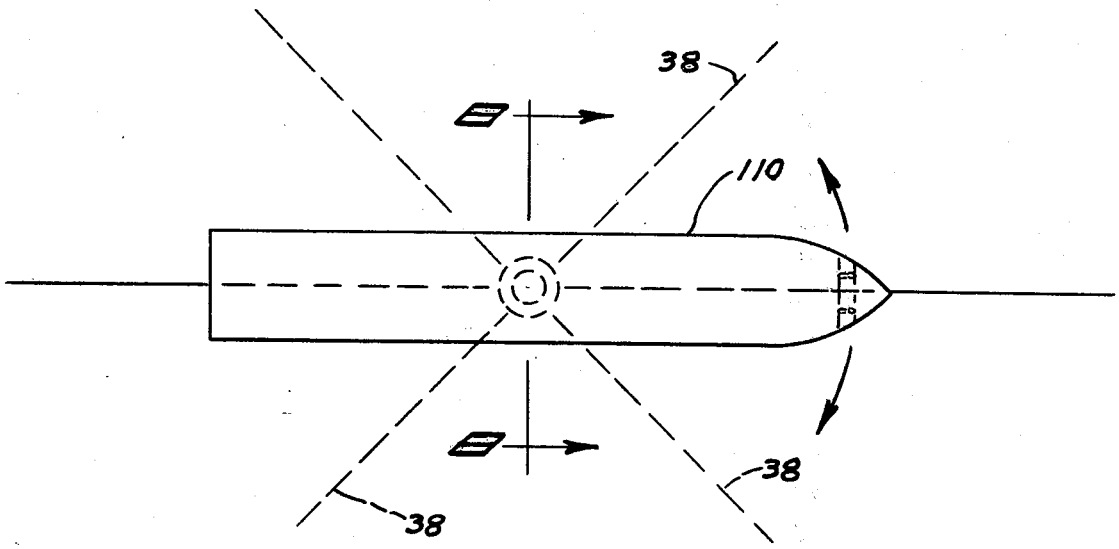
FIG. 7 is a schematic top plan view of a more conventional ship utilizing the apparatus of the present invention.
Figure 8:
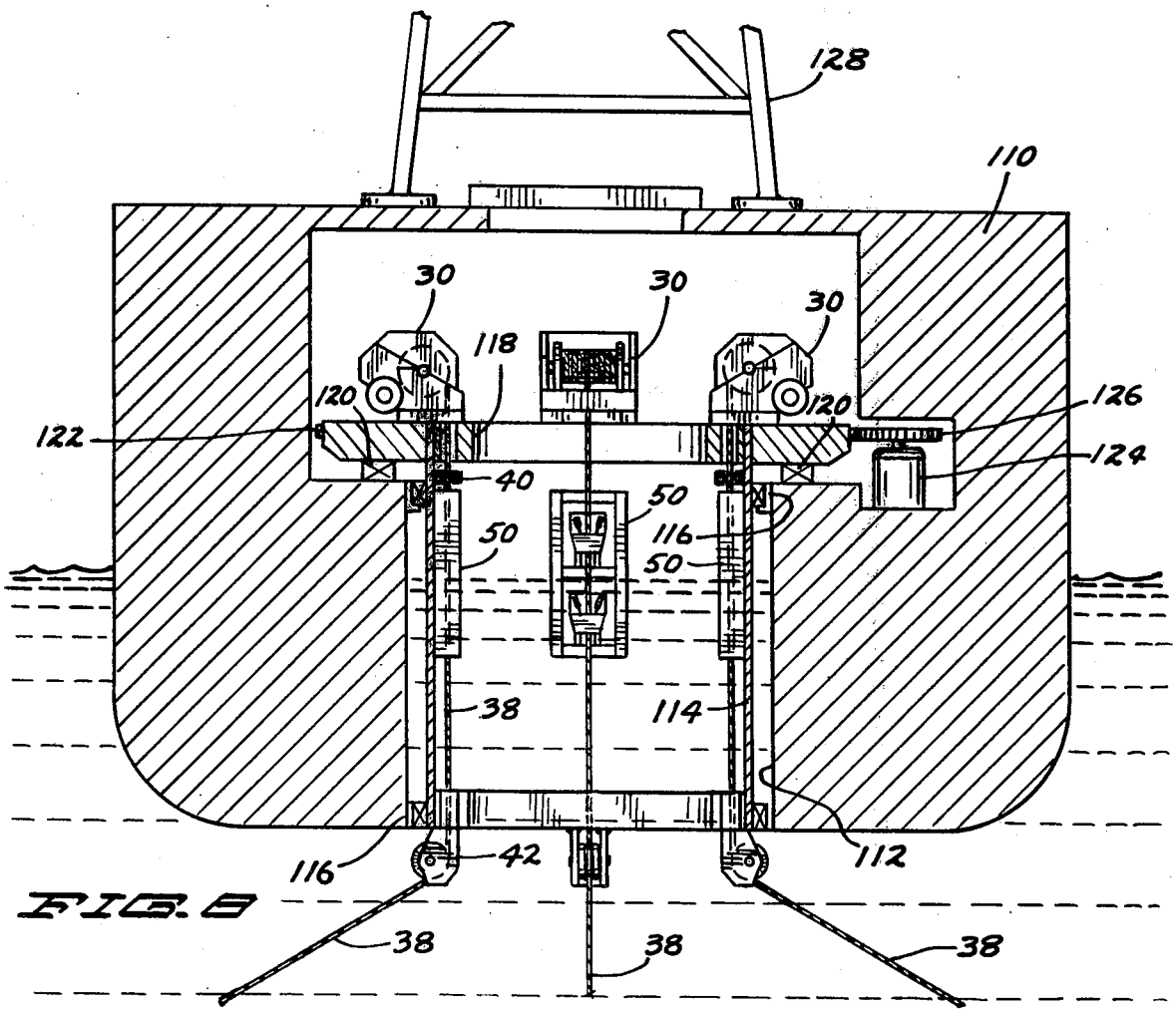
FIG. 8 is a vertical sectional view taken on the line 8—8 in FIG. 7.

Turning now to FIGS. 7 and 8, a more conventional ship 110 is provided with a vertically extending cylindrical opening 112 therethrough. Concentric with and inside of this opening 112 is a cylindrical mooring sleeve 114 rotatably mounted with respect to the ship's vertically extending cylindrical opening 112 as at 116. Integral with that cylindrical mooring sleeve 114 and extending horizontally radially outwardly from it is a winch support platform 118. The weight of this platform is supported on a cylindrical bearing 120 which is supported within the ship 110 to be in concentric and encircling relationship to the cylindrical opening 112 through the ship and with the cylindrical mooring sleeve 114. An appropriate ring gear 122 around the outside of the platform 110 can be driven by a motor 124 and drive pinion 126 to rotate the ship with respect to the positioning of the cylindrical mooring sleeve thus to keep the ship headed into the wind as the wind changes direction.

In the form of the invention as shown, four single drum anchor hoists or winches 30 are mounted 90° apart around the winch support platform 118. Four separate guide means 40 are mounted to the interior surface or the cylindrical mooring sleeve 114 in position so as to encompass mooring lines 38 coming off of each of the winches 30 and to direct these lines 38 to pass vertically down through these guide means.

Four fairleaders or fairlead means 42 will be situated, one each directly vertically below the head sheave guide means 40. The mooring lines 38 extend vertically down from the guide means 40 and through the fairlead means 42.

Four linear pull machines 50 will also be mounted on the interior wall of the cylindrical mooring sleeve, each to be in position to accept and to operate on its own mooring line 38 passing vertically from the head guide means to the fairleader means.

A power unit to provide hydraulic fluid and air under pressure such as the aforesaid power unit 26 (not shown in FIGS. 7 and 8) can be mounted on winch support platform 118 and will supply power to one or more of the pull machine/winch sets.

OPERATION

The operation of this equipment in mooring the ship 110 will be substantially identical with that discussed in connection with mooring of the rig 10, except that there will not need to be an adding of water ballast to the ship 110 and an evacuation of that ballast, and except that only four anchors will be used to precisely position the open center of the vertically extending cylindrical opening 112 and the cylindrical mooring sleeve 114.

Once the center of this cylindrical mooring sleeve is established by the four anchors and mooring lines, an oil exploration and drilling operation can be carried on down through the center of this opening utilizing the oil derrick 128 which is mounted directly over the center of this sleeve 114.

The embodiments of the invention in which an exclusive property or privilege is claimed are defined as follows:

1. A platform-mounted apparatus for drawing in, storing, holding, and paying out a flexible load line having the properties of wire rope and having a load at an outer end thereof, said apparatus including:

A. said flexible load line and its attached load;

B. a power supply mounted with respect to said platform and capable of supplying hydraulic fluid under pressure;

C. winch means including:

(1) a winch frame mounted with respect to the platform, (2) a winch drum to which an inner end of the load line is attached, said drum being rotatably mounted on said frame, (3) braking means operably connected between the drum and the winch frame, (4) hydraulic drum drive means operable to rotate the drum to move the load line in a first direction as it winds on the drum, the drum drive means being operable selectively to power the drum (a) in a slow speed/high torque range, or (b) in a high speed/low torque range, and (5) fluid operable brake control means to cause the braking means selectively to (a) let the winch drum run free, (b) to retard rotation of the winch drum, or (c) to stop it and to hold it against rotation with respect to the winch frame;

D. a hydraulically operable linear load line pull machine mounted with respect to the platform and encompassing a straight run of the load line between said winch drum and said line load, said linear load line pull machine including:

(1) a linear line pull machine frame mounted with respect to the platform, (2) wedge shape gripper jaws slidably mounted on said pull machine frame and adapted to releasably grasp the encompassed portion of the load line to hold it against movement in a second direction opposite the first direction of movement of the load line when it is wound on the winch drum, (3) hydraulic linear pull drive means operable when applied with hydraulic fluid under pressure to move said jaw means reciprocally with respect to said pull machine frame (a) to cause the load line when grasped by the jaw means to move in the first load line direction and (b) to move in the jaws in a second direction, and (4) hydraulic gripper motor means operable in a disengaging direction to disengage said jaw means from said load line and in an engaging direction to cause said jaw means to grasp said load line; and E. control means selectively operable to:

(1) supply hydraulic fluid under pressure from the power supply to the drum drive means and actuate the drum drive means into its high speed/low torque range, actuate the gripper motor means in the disengaged direction, and actuate the brake control means to release the braking means, or (2) supply hydraulic fluid under pressure from the power supply to the drum drive means and actuate the drum drive means into its low speed/high torque range, actuate the gripper motor means in the disengaged direction, and actuate the brake control means to release the braking means, or (3) actuate the gripper motor means in the engaged direction to position the gripper jaws to grasp the load line, supply hydraulic fluid under pressure from the power supply to the drum drive means and actuate the drum drive means into its high speed/low torque range, supply hydraulic fluid under pressure from said power supply to said linear line pull drive means, and actuate said brake control means to release the braking means.

2. The apparatus of claim 1 wherein:

F. the control means is also selectively operable to:

(1) deactivate the winch drum drive means, actuate the gripper motor means in said disengaged direction to disengage said jaw means from said load line, and actuate the brake control means to at least partially release the braking means, or (2) actuate said gripper motor means in the disengaged direction, interrupt the flow of hydraulic fluid in said linear line pull drive means, deactivate the winch drum drive means, and actuate the brake control means to cause said braking means to stop and hold the drum against rotation with respect to the winch frame, or (3) actuate said gripper motor means in the engaged direction, interrupt flow of hydraulic fluid in said linear line pull drive means, and deactivate the winch drum drive means.

* * * * *